US009316952B1

(12) United States Patent
Gan et al.

(10) Patent No.: US 9,316,952 B1
(45) Date of Patent: Apr. 19, 2016

(54) LIQUID SUPPLY DEVICE, DEVELOPING DEVICE, AND IMAGE FORMING APPARATUS

(71) Applicant: FUJI XEROX CO., LTD., Tokyo (JP)

(72) Inventors: Taijyu Gan, Kanagawa (JP); Toshihiko Suzuki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/844,751

(22) Filed: Sep. 3, 2015

(30) Foreign Application Priority Data

Mar. 10, 2015 (JP) ..... 2015-047602

(51) Int. Cl.
*G03G 15/10* (2006.01)

(52) U.S. Cl.
CPC ..... *G03G 15/104* (2013.01)

(58) Field of Classification Search
USPC ..... 399/238, 237, 239
See application file for complete search history.

(56) References Cited

U.S. PATENT DOCUMENTS

| | | | | |
|---|---|---|---|---|
| 4,286,039 | A * | 8/1981 | Landa | G03G 15/11 399/239 |
| 5,765,078 | A * | 6/1998 | Yamamoto | G03G 15/104 399/237 |
| 8,165,503 | B2 * | 4/2012 | Maeda | G03G 15/104 399/240 |
| 8,764,181 | B2 * | 7/2014 | Suzuki | G03G 15/104 101/350.5 |
| 2009/0196657 | A1 * | 8/2009 | Okumura | G03G 15/104 399/237 |

FOREIGN PATENT DOCUMENTS

| | | |
|---|---|---|
| JP | 2002-278295 A | 9/2002 |
| JP | 2008-170604 A | 7/2008 |
| JP | 2009-211043 A | 9/2009 |

* cited by examiner

*Primary Examiner* — Clayton E LaBalle
*Assistant Examiner* — Warren K Fenwick
(74) *Attorney, Agent, or Firm* — Oliff PLC

(57) ABSTRACT

A liquid supply device includes a rotating supply member that holds a liquid developer in concave portions formed on an outer peripheral surface, and supplies the liquid developer to a target supply member, a regulating member that regulates a liquid developer holding amount of the outer peripheral surface of the rotating supply member by contacting with the outer peripheral surface of the rotating supply member, and a movement unit that moves the regulating member to a retract position which is separated from the outer peripheral surface of the rotating supply member.

13 Claims, 4 Drawing Sheets

LIQUID SUPPLY DEVICE, DEVELOPING DEVICE, AND IMAGE FORMING APPARATUS

CROSS-REFERENCE TO RELATED APPLICATIONS

This application is based on and claims priority under 35 USC 119 from Japanese Patent Application No. 2015-047602 filed Mar. 10, 2015.

BACKGROUND

Technical Field

The present invention relates to a liquid supply device, a developing device, and an image forming apparatus.

SUMMARY

According to an aspect of the invention, there is provided a liquid supply device including:

a rotating supply member that holds a liquid developer in concave portions formed on an outer peripheral surface, and supplies the liquid developer to a target supply member;

a regulating member that regulates a liquid developer holding amount of the outer peripheral surface of the rotating supply member by contacting with the outer peripheral surface of the rotating supply member; and a movement unit that moves the regulating member to a retract position which is separated from the outer peripheral surface of the rotating supply member.

BRIEF DESCRIPTION OF THE DRAWINGS

Exemplary embodiments of the present invention will be described in detail based on the following figures, wherein.

DETAILED DESCRIPTION

First Exemplary Embodiment

Examples of a liquid supply device, a developing device and an image forming apparatus according to a first exemplary embodiment will be described.

Overall Configuration

Figure 1:
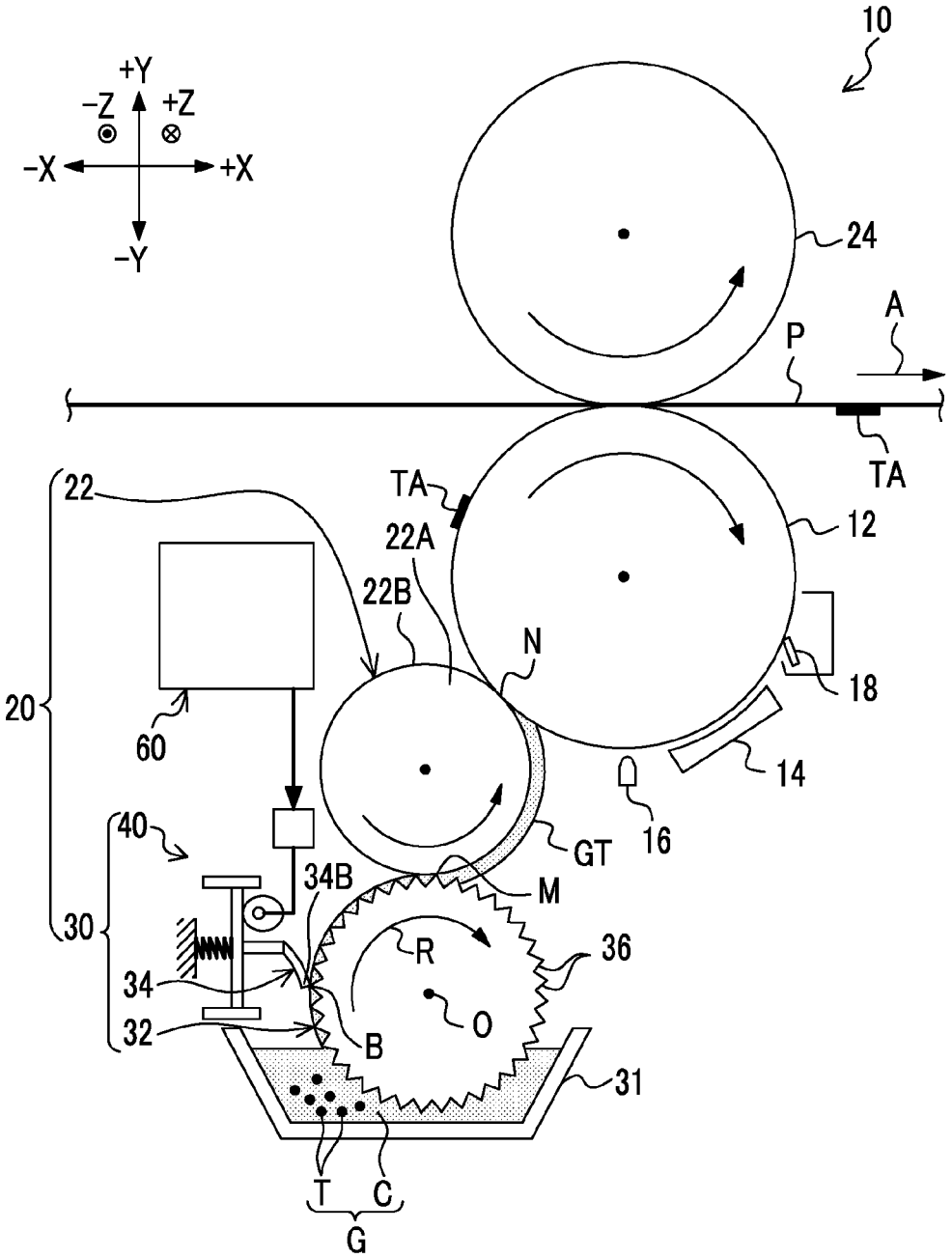
FIG. 1 is an overall configuration diagram of an image forming apparatus according to a first exemplary embodiment.

FIG. 1 shows an image forming apparatus 10 of a first exemplary embodiment. In the following description, a direction that is shown by an arrow Y in FIG. 1 will be referred to as a device height direction, and a direction that is shown by an arrow X in FIG. 1 will be referred to as a device width direction. In addition, a direction (shown by Z) that is respectively orthogonal to the device height direction and the device width direction will be referred to as a device depth direction. Further, when the image forming apparatus 10 is viewed from a side (viewed from the front) on which a user (not illustrated) stands, the device width direction, the device height direction and the device depth direction will be referred to as an X direction, a Y direction and a Z direction. The Y direction is an example of a gravitational direction.

Furthermore, in a case in which it is necessary to discriminate between one side and the other side of the X direction, the Y direction and the Z direction, when the image forming apparatus 10 is viewed from the front, an upper side will be referred to as a +Y side, a lower side will be referred to as a −Y side, a right side will be referred to as a +X side, a left side will be referred to as a −X side, a deep side will be referred to as a +Z side, and a front side will be referred to as a −Z side.

The image forming apparatus 10 is configured to include a photosensitive member 12 as an example of an image holding member, a charging device 14, an exposure device 16, a developing device 20, a transfer roller 24 as an example of a transfer unit, a cleaning blade 18, and a fixing unit (not illustrated). In addition, the image forming apparatus 10 includes a transport roller (not illustrated) that transports sheets of paper P, as an example of a target transfer member, in a direction that is shown by an arrow A. Furthermore, in the image forming apparatus 10, image formation is performed using a liquid developer G, and the fixing unit fixes toner images TA, as an example of developer images on sheets of paper P, to sheets of paper P by heating and pressurizing the toner images TA.

Liquid Developer

As one example, the liquid developer G is set so that toner T is dispersed in a carrier liquid C, and a solid component concentration thereof is set as 25 (% by weight). An insulating liquid such as vegetable oil, liquid paraffin oil, silicone oil, or the like is used as the carrier liquid C, and in the exemplary embodiment, as an example, silicone oil is used. In addition, as an example, toner particles in which a polyester resin, which is a thermoplastic resin, is set as the main component of a binding resin, is used in the toner T.

Furthermore, as an example, after being thermally managed inside a heat exchanger-equipped storage tank (not illustrated) that is provided separately to the developing device 20, the liquid developer G is supplied to the developing device 20. Additionally, a lower limit temperature in the thermal management of the liquid developer G is determined based on a temperature at which the liquid developer G does not form condensation inside the image forming apparatus 10. In addition, an upper limit temperature in the thermal management of the liquid developer G is determined so as to be less than the glass transition temperature of the toner T.

Photosensitive Member

As an example, the photosensitive member 12 includes a substrate, which is a cylindrical shape and is grounded, and a photosensitive layer (not illustrated) that is formed at the outer peripheral surface of the substrate, and holds a latent image at the outer peripheral surface thereof. In addition, the photosensitive member 12 is supported so as to be capable of rotating with the Z direction as an axial direction thereof, by a frame (not illustrated), which is provided inside the image forming apparatus 10. The charging device 14, which charges the outer peripheral surface of the photosensitive member 12, the exposure device 16, which forms a latent image by exposing the outer peripheral surface of the photosensitive member 12, the developing device 20, which will be described later, and the cleaning blade 18, which cleans the outer peripheral surfaces of the transfer roller 24 and the photosensitive member 12, are disposed in the vicinity of the photosensitive member 12.

Transfer Roller

The transfer roller 24 is provided further on a downstream side in a rotational direction of the photosensitive member 12 than the developing device 20, and further on an upstream side than the cleaning blade 18 with the Z direction as an axial direction thereof. In addition, the transfer roller 24 and the photosensitive member 12 interpose sheets of paper P therebetween. Furthermore, a difference in potential, which causes the toner images TA held on the outer peripheral surface of the photosensitive member 12 to be transferred to sheets of paper P after developing, which will be described later, is generated between the transfer roller 24 and the photosensitive member 12. In this manner, the toner images TA of the photosensitive member 12 are transferred to sheets of paper P at a transfer position, which is interposed between the photosensitive member 12 and the transfer roller 24.

Developing Device

As shown in FIG. 1, the developing device 20 is provided further on the downstream side in the rotational direction of the photosensitive member 12 than the exposure device 16, and further on the upstream side than the transfer roller 24. In addition, the developing device 20 includes a developing roller 22, as one example of a developing rotating member and a target supply member, and a supply device 30 as an example of a liquid supply device that supplies the liquid developer G to the developing roller 22.

Developing Roller

The developing roller 22 has a configuration in which an elastic layer 22B is provided at the outer peripheral surface of a metallic columnar core roller 22A. The core roller 22A is supported so as to be capable of rotating with the Z direction as the axial direction thereof, by the frame (not illustrated), which is provided inside the image forming apparatus 10. In addition, a bias voltage is applied to the core roller 22A from a power source (not illustrated). Additionally, the length of the core roller 22A in the axial direction of the developing roller 22 is longer than the length of the elastic layer 22B.

In addition, the elastic layer 22B of the developing roller 22 contacts with the outer peripheral surface of a supply roller 32, which will be described later. Further, a developer layer GT of the liquid developer G is formed on the developing roller 22 at a contact section M between the developing roller 22 and the supply roller 32. Furthermore, the elastic layer 22B of the developing roller 22 forms a developing nip section N by contacting with the outer peripheral surface of the photosensitive member 12.

In this manner, the developing roller 22 forms the toner images TA on the outer peripheral surface of the photosensitive member 12 by holding the liquid developer G supplied from the supply roller 32 at the outer peripheral surface thereof, and developing (visualizing) latent images of the photosensitive member 12 using the liquid developer G (the developer layer GT). Additionally, the supply roller 32 and the developing roller 22 move in the same direction at the contact section M, and the developing roller 22 and the photosensitive member 12 move in the same direction at the developing nip section N.

Main Section Configuration

Next, the supply device 30 will be described.

As shown in FIG. 1, the supply device 30 includes a reservoir 31, which stores the liquid developer G, the supply roller 32 as an example of a rotating supply member, a blade 34 as an example of a regulating member, and a retracting mechanism unit 40 as an example of a movement unit.

Reservoir

As an example, the reservoir 31 that is shown in FIG. 1 is formed in a box shape that is long in the Z direction, and open on the +Y side. In addition, the reservoir 31 is disposed on the −Y side of the supply roller 32 in a state in which an open side thereof faces the outer peripheral surface of the supply roller 32. Furthermore, the reservoir 31 is disposed so as to face a site on the outer peripheral surface of the supply roller 32 that moves toward the −X side from the +X side.

A supply pipe (not illustrated), which supplies the liquid developer G to the inside of the reservoir 31, is connected to a −Y side end (a lower end) of the reservoir 31. In addition, a discharge pipe (not illustrated), which discharges the liquid developer G that becomes surplus inside the reservoir 31, is connected to a +Y side end (an upper end) of the reservoir 31. In this instance, the liquid developer G flows into and is stored inside the reservoir 31 as a result of the liquid developer G being fed from the storage tank (not illustrated) into the inside of the supply pipe using a pump. The liquid developer G that becomes surplus inside the reservoir 31 is recovered by a collecting tank (not illustrated) through the discharge pipe.

Supply Roller

The supply roller 32 that is shown in FIG. 1 is formed in a cylindrical shape, and is an anilox roller that holds a portion of the liquid developer G of the reservoir 31 and supplies the liquid developer G to the contact section M of the developing roller 22. As an example, the diameter of the supply roller 32 is set as 120 mm. In addition, the supply roller 32 is supported so as to be capable of rotating about a self axis with the Z direction as the axial direction thereof, by a housing (not illustrated) of the image forming apparatus (refer to FIG. 1). In the following description, a rotational direction of the supply roller 32 will be referred to as an R direction.

Cells 36, as an example of concave portions, multiple numbers of which are arranged in a peripheral direction, and which are open on a diameter direction outer side of the supply roller 32, are formed at the outer peripheral surface of the supply roller 32. As an example, the cells 36 are formed by carrying out laser engraving on a ceramic coating layer formed by performing a plasma spraying treatment on a metallic roller peripheral surface. The volume of the cells 36 is set to be a size at which it is possible to hold the liquid developer G, and at which it is difficult for arrangement patterns of the cells 36 to appear in the toner images TA, and as an example, is set as approximately 12 mL (milliliters)/$m^2$. Additionally, in FIG. 1, multiple cells 36 are shown at an outer peripheral section of the supply roller 32 in triangular shape when the supply roller 32 is viewed macroscopically in the Z direction, but when viewed microscopically, there is a curved surface that forms the outer peripheral surface of the supply roller 32 between adjacent cells 36. In addition, in FIG. 1, the cells 36 are shown in an exaggerated manner so that the cells 36 may be seen clearly.

In addition, in the supply roller 32, a lower end (−Y side) portion is immersed in the liquid developer G of the reservoir 31. Further, as a result of the lower end portion of the supply roller 32 being immersed in the liquid developer G of the reservoir 31 while rotating, the liquid developer G is held on the outer peripheral surface thereof, and therefore, the liquid developer G is supplied to the outer peripheral surface of the developing roller 22.

Blade

Figure 2A:
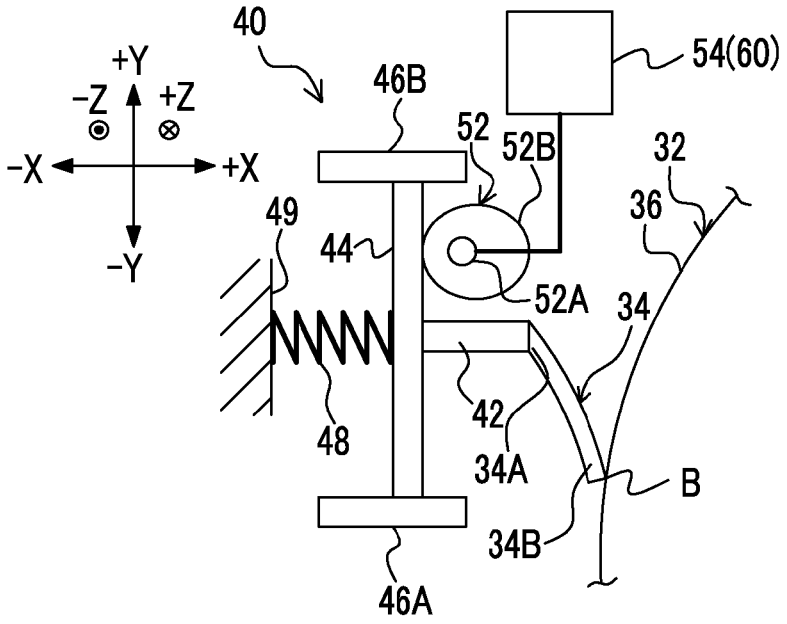
FIGS. 2A and 2B are explanatory drawings that show position change states of a blade according to a retracting mechanism unit according to the first exemplary embodiment.

As an example, the blade 34 that is shown in FIG. 2A is made from stainless steel, and is formed in a plate shape in which the Z direction is set as a long direction with a thickness of 0.3 mm. In addition, the length in the Z direction of the blade 34 is substantially the same length as the length in the Z direction of the outer peripheral surface of the supply roller 32. A base end 34A of the −X side of the blade 34 in a short direction is fixed to a blade holder 42, which will be described later. An edge portion 34B of the +X side of the blade 34 in the short direction contacts with the outer peripheral surface of the supply roller 32. Additionally, as an example, a step-providing treatment (not illustrated) is carried out on the edge portion of the blade 34.

In addition, the blade 34 is disposed inclined along a direction that intersects the Y direction when viewed from the Z direction (at the X-Y plane), and the edge portion 34B is disposed on a +X side and a −Y side with respect to the base end 34A. A contact position on the X-Y plane between the edge portion 34B and the outer peripheral surface of the supply roller 32 will be referred to as a point B. As an example, the point B is positioned further on the +Y side than a rotational center O (refer to FIG. 1) of the supply roller 32.

In this manner, the blade 34 is disposed so that a direction in which the edge portion 34B extends is a counter direction with respect to the R direction. Further, the blade 34 regulates an amount of the liquid developer G (refer to FIG. 1) on the outer peripheral surface of the supply roller 32 that is transported toward the contact section M as a result of contacting with the outer peripheral surface of the supply roller 32. Additionally, the regulating of the amount refers to decreasing a surplus amount, among the liquid developer G held on the outer peripheral surface of the supply roller 32, to a required amount of the liquid developer G at the contact section M by scraping the liquid developer G off using the blade 34.

Retracting Mechanism Unit

The retracting mechanism unit 40 that is shown in FIG. 2A is configured to include the blade holder 42, a sliding member 44, guide rails 46A and 46B, a compression coil spring 48, a cam 52, a motor 54, and a control unit 60 (refer to FIG. 1). In addition, the retracting mechanism unit 40 is disposed on the −X side of the supply roller 32.

Figure 2B:
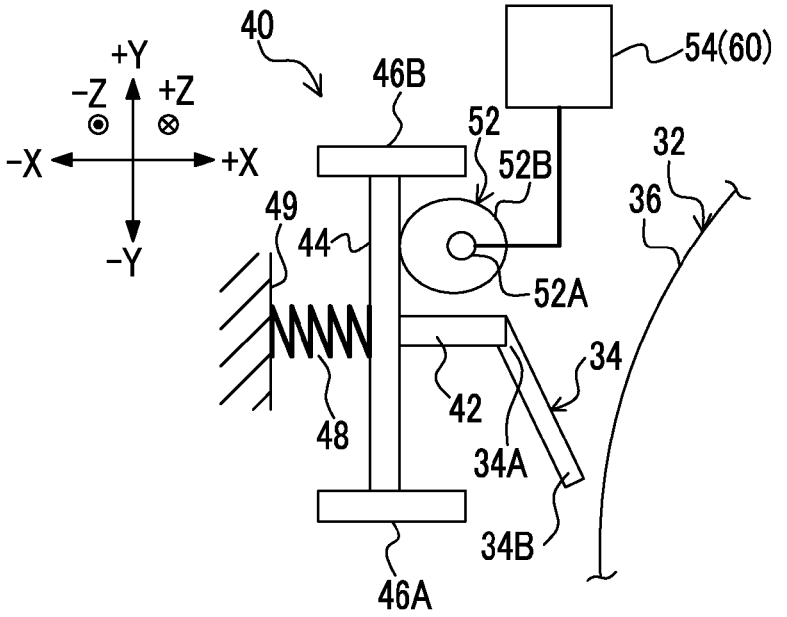

The guide rail 46A and the guide rail 46B are attached to the housing (not illustrated) of the supply device 30 (refer to FIG. 1). Additionally, the guide rail 46A and the guide rail 46B are respectively provided with one set each on the +Z side and the −Z side, but since the configuration of each set is the same, the guide rail 46A and the guide rail 46B of the −Z side is shown in FIGS. 2A and 2B.

In addition, the guide rail 46A and the guide rail 46B respectively extend along the X direction, and face the Y direction. Furthermore, as an example, the guide rail 46A and the guide rail 46B support the sliding member 44, which will be described later, in a manner in which Y-Z cross-section forms an L shape, and the sliding member 44 does not deviate from the guide rail 46A and the guide rail 46B.

As an example, the sliding member 44 is formed in a rectangular parallelepiped shape that is long in the Z direction. In addition, the sliding member 44 is capable of moving along the X direction as a result of a +Z side end and a −Z side end being supported and guided by the two sets of the guide rail 46A and the guide rail 46B. A −X side end of the blade holder 42, which will be described later, is fixed to a side surface of a +X side of the sliding member 44. A +X side end of the compression coil spring 48 contacts with a side surface of a −X side of the sliding member 44.

The compression coil spring 48 is disposed so that a flexible direction runs along the X direction, and is interposed between a bracket 49, which is provided in the housing (not illustrated) of the supply device 30 (refer to FIG. 1), and the sliding member 44 in a compressed state. That is, the compression coil spring 48 applies a biasing force, which acts toward the +X side, to the sliding member 44.

As an example, the blade holder 42 is formed in a plate shape in which the X direction is set as a short direction and the Z direction is set as a long direction. In addition, a notched section (not illustrated), which is open on the +X side, is formed at an end of the +X side of the blade holder 42. The base end 34A of the blade 34 is inserted into the notched section of the blade holder 42, and fixed with a screw. As a result of this, the blade 34 is supported by the blade holder 42 and the sliding member 44, and is biased toward the supply roller 32.

The cam 52 includes a cam shaft 52A, and a cam main member 52B that is fixed to the cam shaft 52A. The cam shaft 52A is driven by the motor 54. A portion of the outer peripheral surface of the cam main member 52B contacts with a side surface of a +X side of the sliding member 44, and presses the sliding member 44 to the −X side. The motor 54 is electrically connected to the control unit 60, and is controlled to drive by the control unit 60. As an example, the control unit 60 performs driving control of each section of the image forming apparatus 10 (refer to FIG. 1).

In FIGS. 2A and 2B, the position of the cam 52 is shown shifted to the +Y side so that the cam 52 and the blade holder 42 may be seen, but the cam 52 contacts with a central part of the sliding member 44 in the Y direction. Therefore, a circumstance in which the sliding member 44 is inclined in a direction that intersects the Y direction as a result of contacting with the cam 52, is suppressed.

In this instance, as shown in FIG. 2A, by controlling the motor 54, the control unit 60 is set to drive the cam 52 to rotate so that the edge portion 34B of the blade 34 is disposed in the contact position B, which contacts with the outer peripheral surface of the supply roller 32, at a time point before the supply roller 32 rotates. Additionally, in a stopped state (an initial state) before the supply roller 32 rotates, the edge portion 34B is disposed in a retract position, which will be described later. In addition, during rotation of the supply roller 32, the edge portion 34B is disposed in the contact position B.

As shown in FIG. 2B, by controlling the motor 54, the control unit 60 is set to drive the cam 52 to rotate so that the blade 34 is positioned in the retract position, which is separated from the outer peripheral surface of the supply roller 32 on the −X side when rotation of the supply roller is stopped. Additionally, in the first exemplary embodiment, as an example, a position at which the blade 34 is in a non-contact state with the outer peripheral surface of the supply roller 32 and at which the liquid developer G is not in a state of being interposed between the edge portion 34B and the outer peripheral surface of the supply roller 32 (an air layer is interposed therebetween) is set as the retract position.

Comparative Example

A supply device (not illustrated) in which the edge portion 34B of the blade 34 contacts with the outer peripheral surface of the supply roller 32 in a state in which rotation of the supply roller 32 is stopped is set as a supply device of a comparative example. In the supply device of the comparative example, the edge portion 34B emits heat due to friction with the supply roller 32 when the supply roller 32 rotates, and the temperature of the edge portion 34B rises. Additionally, since the liquid developer G is continuously supplied to the edge portion 34B during rotation of the supply roller 32, it is difficult for the temperature of the edge portion 34B to become high, and therefore, the adherence of resin particles of the toner T to the inner surface of the multiple cells 36 is suppressed.

Meanwhile, the liquid developer G is not supplied to the contact position B between the edge portion 34B and the supply roller 32 when rotation of the supply roller 32 is stopped. As a result of this, it is difficult for the blade 34 to be cooled by the liquid developer G, and therefore, the temperature of the edge portion 34B rises. Further, resin particles of the toner T of a portion of the liquid developer G that is at the periphery of the contact position B is heated by the edge portion 34B, the temperature of which is raised, and melt or become softened. Therefore, in the supply device of the comparative example, there is a potential for the resin particles of the toner T, which are melted or softened, will become adhered to inner surfaces of the multiple cells 36 of the supply roller 32 when rotation of the supply roller 32 is stopped.

In addition, in the supply device of the comparative example, in a case in which resin particles of the toner T become adhered to the inner surfaces of the cells 36, the volume of the cells 36 is reduced in comparison with a case in which the resin particles do not become adhered thereto. As a result of this, there is a potential for the supply amount of the liquid developer G that is supplied from the supply roller 32 to the developing roller 22 to be decreased.

Mechanisms

Next, the mechanisms of the first exemplary embodiment will be described.

In the image forming apparatus 10 that is shown in FIG. 1, as an example, when an instruction to initiate image formation is input to the control unit 60 from an external device, the control unit 60 drives the retracting mechanism unit 40, and moves the edge portion 34B of the blade 34 to the contact position B. Furthermore, the control unit 60 initiates rotation of the photosensitive member 12, the transfer roller 24, the developing roller 22, and the supply roller 32.

Figure 3A:
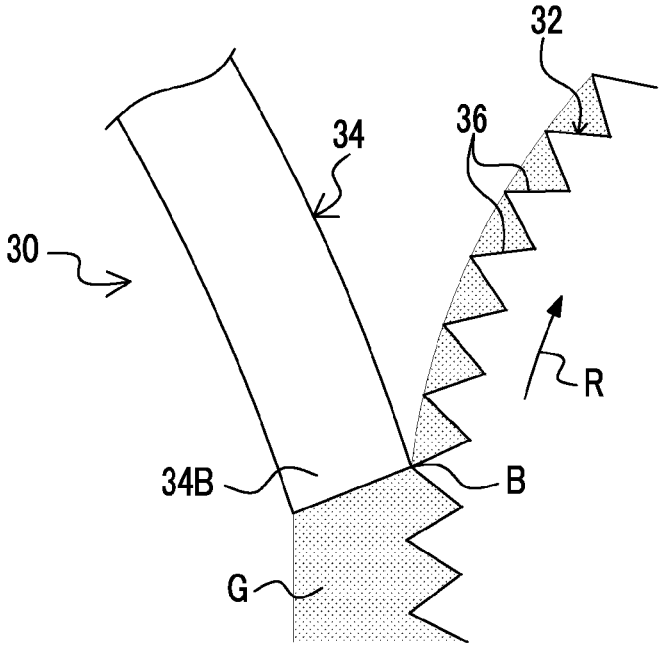
FIG. 3A is an explanatory drawing that shows a state in which a blade according to the first exemplary embodiment contacts with an outer peripheral surface of a supply roller.

As shown in FIG. 3A, in the supply device 30, the holding amount of the liquid developer G on the outer peripheral surface of the supply roller 32 is regulated by the blade 34 scraping a surplus amount of the liquid developer G held on the outer peripheral surface of the supply roller 32 off. Additionally, in FIG. 3A, illustration of the retracting mechanism unit 40 (refer to FIG. 1) is omitted. In addition, in FIG. 3A, the cells 36 are shown in an exaggerated manner.

Figure 3B:
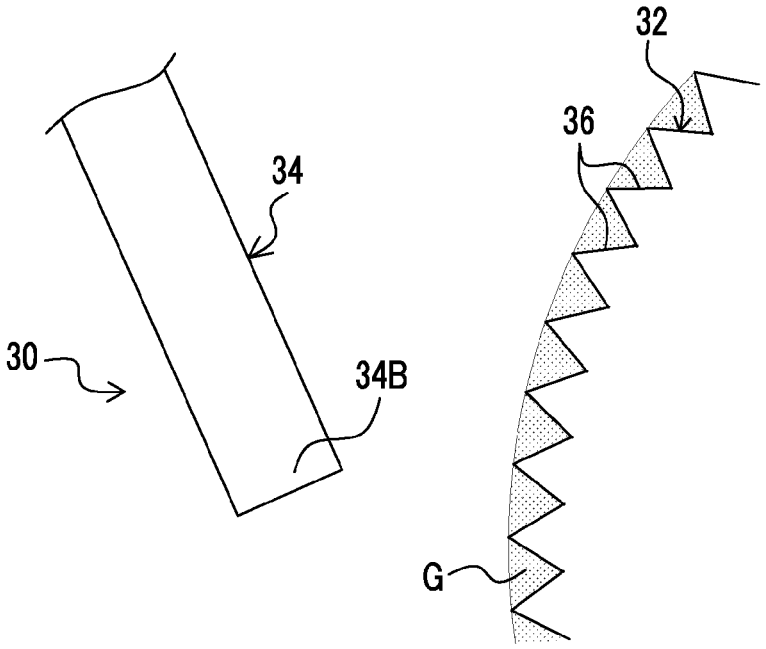
FIG. 3B is an explanatory drawing that shows a state in which the blade according to the first exemplary embodiment becomes separated from the outer peripheral surface of the supply roller.

When a developing process in the image forming apparatus 10 (refer to FIG. 1) is completed, and as shown in FIG. 3B, the rotation of the supply roller 32 is stopped, the control unit 60 (refer to FIG. 1), drives the retracting mechanism unit 40 (refer to FIG. 1), and moves the edge portion 34B of the blade 34 to the retract position. As a result of this, since the edge portion 34B and the outer peripheral surface of the supply roller 32 are in a non-contact state, even if the temperature of the edge portion 34B rises when rotation of the supply roller 32 is stopped, it is difficult for the liquid developer G of the outer peripheral surface of the supply roller 32 to be heated by the heat amount of the edge portion 34B. Therefore, in the supply device 30, the adherence of resin particles of the toner T (refer to FIG. 1) to the multiple cells 36 is suppressed in comparison with the supply device of the comparative example mentioned above. Additionally, in FIG. 3B, illustration of the retracting mechanism unit 40 (refer to FIG. 1) is omitted. In addition, in FIG. 3B, the cells 36 are shown in an exaggerated manner.

In the developing device 20 that is shown in FIG. 1, by suppressing a circumstance in which a portion of the toner T melts or becomes softened, and becomes adhered to the cells 36, a circumstance in which the holding amount of the liquid developer G that is held on the outer peripheral surface of the supply roller 32 is partially reduced, is suppressed. Therefore, in the developing device 20, a circumstance in which the supply amount of the liquid developer G, which is supplied from the supply roller 32 to the developing roller 22, is reduced, is suppressed in comparison with a configuration that includes the supply device of the comparative example mentioned above. As a result of this, in the developing device 20, developing defects (for example, insufficient amounts of the toner T being transferred to the photosensitive member 12) that are caused by a portion of the liquid developer G becoming adhered to the supply roller 32, are suppressed.

In the image forming apparatus 10 that is shown in FIG. 1, since developing defects are suppressed in the developing device 20, image defects after transfer (for example, irregularities in the image concentration of the toner images TA) are suppressed in comparison with a configuration that includes the supply device of the comparative example mentioned above.

In this instance, as an example, in the image forming apparatus 10 of the first exemplary embodiment, an entire surface halftone image is printed with an image density of 50% by stopping the supply roller 32 after driving the supply roller 32 to rotate for 10 minutes at a peripheral velocity of 40 m/min, and allowing 1 minute to pass after stopping the supply roller 32. As a result of this, irregularities in image concentration could not be seen by eye.

Second Exemplary Embodiment

Next, examples of a liquid supply device, a developing device and an image forming apparatus according to a second exemplary embodiment will be described. Additionally, the same symbols as the first exemplary embodiment will be given to the same members and sites as the first exemplary embodiment, and descriptions thereof will be omitted.

In the supply device 30 of the second exemplary embodiment, a position at which the blade 34 is in a non-contact state with the outer peripheral surface of the supply roller 32 and at which the liquid developer G is in a state of being interposed between the edge portion 34B and the outer peripheral surface of the supply roller 32 (an air layer is not interposed therebetween) is set as the retract position. As an example, an interval between the edge portion 34B and the supply roller 32 is 0.5 mm when the blade 34 is moved to (disposed in) the retract position. Additionally, configurations other than the retract position are the same configurations as those of the supply device 30, the developing device 20 and the image forming apparatus 10 of the first exemplary embodiment.

Mechanisms

Next, the mechanisms of the second exemplary embodiment will be described.

In the image forming apparatus 10 of the second exemplary embodiment that is shown in FIG. 1, as an example, when an instruction to initiate image formation is input to the control unit 60 from an external device, the control unit 60 drives the retracting mechanism unit 40, and moves the edge portion 34B of the blade 34 to the contact position B. Furthermore, the control unit 60 initiates rotation of the photosensitive member 12, the transfer roller 24, the developing roller 22, and the supply roller 32.

Figure 4A:
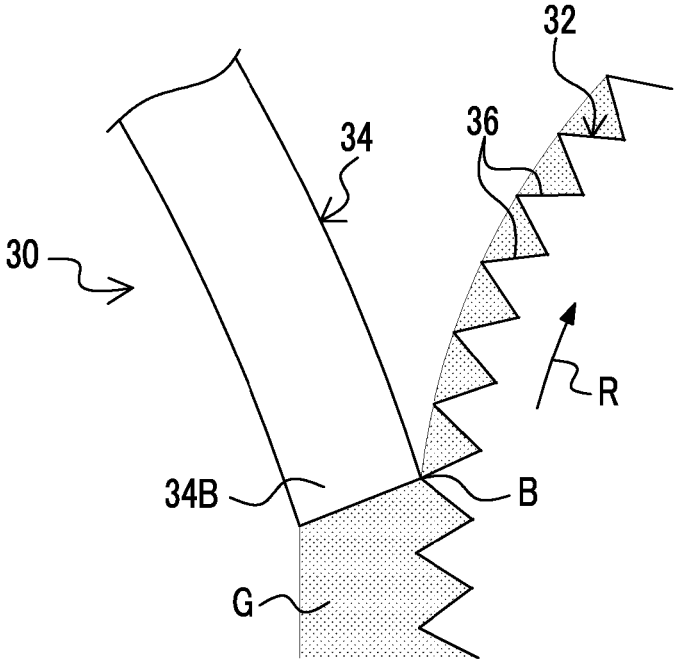
FIG. 4A is an explanatory drawing that shows a state in which a blade according to a second exemplary embodiment contacts with an outer peripheral surface of a supply roller.

As shown in FIG. 4A, in the supply device 30 of the second exemplary embodiment, the holding amount of the liquid developer G on the outer peripheral surface of the supply roller 32 is regulated by the blade 34 scraping a surplus amount of the liquid developer G held on the outer peripheral surface of the supply roller 32 off. Additionally, in FIG. 4A, illustration of the retracting mechanism unit 40 (refer to FIG. 1) is omitted. In addition, in FIG. 4A, the cells 36 are shown in an exaggerated manner.

Figure 4B:
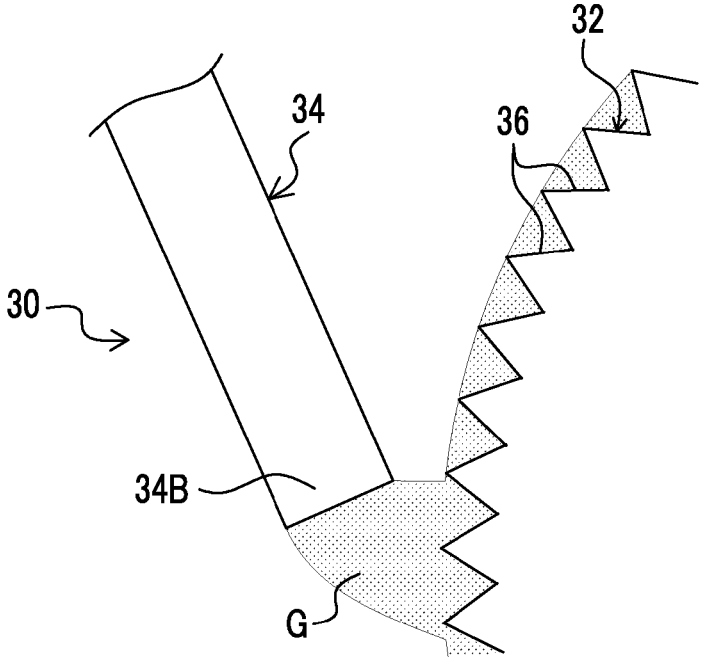
FIG. 4B is an explanatory drawing that shows a state in which the blade according to the second exemplary embodiment becomes separated from the outer peripheral surface of the supply roller.

When a developing process in the image forming apparatus 10 (refer to FIG. 1) is completed, and as shown in FIG. 4B, the rotation of the supply roller 32 is stopped, the control unit 60 (refer to FIG. 1), drives the retracting mechanism unit 40 (refer to FIG. 1), and moves the edge portion 34B of the blade 34 to the retract position. As a result of this, since the edge portion 34B and the outer peripheral surface of the supply roller 32 are in a non-contact state, even if the temperature of the edge portion 34B rises when rotation of the supply roller 32 is stopped, it is difficult for the liquid developer G of the outer peripheral surface of the supply roller 32 to be heated by the heat amount of the edge portion 34B. Therefore, in the supply device 30 of the second exemplary embodiment, the adherence of resin particles of the toner T (refer to FIG. 1) to the multiple cells 36 is suppressed in comparison with the supply device of the comparative example mentioned above. Additionally, in FIG. 4B, illustration of the retracting mechanism unit 40 (refer to FIG. 1) is omitted. In addition, in FIG. 4B, the cells 36 are shown in an exaggerated manner.

Furthermore, in the supply device 30 of the second exemplary embodiment, in a state in which rotation of the supply roller 32 is stopped, the liquid developer G is interposed between the edge portion 34B of the blade 34 and the outer peripheral surface of the supply roller 32. Therefore, since the edge portion 34B is cooled by the liquid developer G, the cooling effect of the blade 34 is enhanced in comparison with a configuration in which the liquid developer G is not interposed between the edge portion 34B and the outer peripheral surface of the supply roller 32 in a state in which rotation of the supply roller 32 is stopped.

In this instance, as an example, in the image forming apparatus 10 of the second exemplary embodiment, an entire surface halftone image is printed with an image density of 50% by stopping the supply roller 32 after driving the supply roller 32 to rotate for 10 minutes at a peripheral velocity of 40 m/min, and allowing 1 minute to pass after stopping the supply roller 32. As a result of this, irregularities in image concentration could not be seen by eye.

Additionally, the present invention is not limited to the abovementioned exemplary embodiments.

The image forming apparatus 10 is not limited to an image forming apparatus that forms images on sheets of paper P using liquid developer G of one color, and may be an image forming apparatus that forms images on sheets of paper P using liquid developers G of multiple colors. For example, the image forming apparatus 10 may be an image forming apparatus that has a configuration in which multiple developing devices 20 are arranged with respect to the photosensitive member 12.

The supply roller 32 is not limited to a supply roller in which multiple cells 36 are formed at the outer peripheral surface thereof, and may be a supply roller in which long carved grooves are formed at the outer peripheral surface in an oblique direction that intersects an axial direction. In addition, the shapes (patterns) of the cells 36 may be pyramid type patterns, lattice type patterns, honeycomb type patterns, or random patterns.

The blade 34 is not limited to being made from a metal such as stainless steel, and may be made from a resin. For example, the blade 34 may use a blade that is made from urethane. In addition, the cross sectional shape of the blade 34 is not limited to being rectangular when viewed in the Z direction, and may be a shape in which a portion is curved or bent.

The movement unit of the blade 34 is not limited to the retracting mechanism unit 40 that uses the cam 52, and may be a movement unit that uses a solenoid, a ball screw, a belt or a linear actuator. In addition, the movement direction of the blade 34 is not limited to a diameter direction of the supply roller 32 (the X direction), and may be a direction that intersects the diameter direction (for example, the Y direction). The movement direction of the blade 34 may be an oblique direction with respect to the X direction. Furthermore, the blade 34 may be moved to the −Y side with respect to the contact position B, and the edge portion 34B may be cooled by being immersed in the liquid developer G.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid supply device comprising:

a rotating supply member that holds a liquid developer in concave portions formed on an outer peripheral surface, and supplies the liquid developer to a target supply member;

a regulating member that regulates a liquid developer holding amount of the outer peripheral surface of the rotating supply member by contacting with the outer peripheral surface of the rotating supply member; and a movement unit that moves the regulating member to a retract position which is separated from the outer peripheral surface of the rotating supply member.

2. The liquid supply device according to claim 1, wherein the retract position is a position at which the liquid developer is interposed between an edge portion of the regulating member and the rotating supply member.

3. The liquid supply device according to claim 1, wherein the regulating member is a plate-shaped scraping member.

4. The liquid supply device according to claim 1, wherein the liquid developer contains toner particles and a silicone oil.

5. The liquid supply device according to claim 4, wherein the toner particle contains a polyester resin.

6. A developing device comprising:

the liquid supply device according to claim 1; and a developing rotating member as a target supply member that develops using a liquid developer supplied from a rotating supply member by contacting with an outer peripheral surface of the rotating supply member of the liquid supply device.

7. The developing device according to claim 6, wherein the retract position of the liquid supply device is a position at which the liquid developer is interposed between an edge portion of the regulating member and the rotating supply member.

8. The developing device according to claim 6, wherein the regulating member of the liquid supply device is a plate-shaped scraping member.

9. The developing device according to claim 6, wherein the liquid developer of the liquid supply device contains toner particles and a silicone oil.

10. The developing device according to claim 9, wherein the toner particle contains a polyester resin.

11. An image forming apparatus comprising:

an image holding member on which an electrostatic latent image is formed;

the developing device according to claim 6 that develops the latent image with a liquid developer; and a transfer unit that transfers a developer image developed by the developing device to a target transfer member.

12. The image forming apparatus according to claim 11, wherein a retract position of a liquid supply device is a position at which the liquid developer is interposed between an edge portion of a regulating member and a rotating supply member.

13. The image forming apparatus according to claim 11, wherein the regulating member of the liquid supply device is a plate-shaped scraping member.

* * * * *